US007841424B2

(12) United States Patent
Chen

(10) Patent No.: US 7,841,424 B2
(45) Date of Patent: Nov. 30, 2010

(54) POWER OUTPUT MECHANISM FOR POWER TOOLS

(75) Inventor: Ting-Kuang Chen, Keelung (TW)

(73) Assignee: Power Network Industry Co., Ltd., Ping-Jen (TW)

( * ) Notice: Subject to any disclaimer, the term of this patent is extended or adjusted under 35 U.S.C. 154(b) by 427 days.

(21) Appl. No.: 12/117,263

(22) Filed: May 8, 2008

(65) Prior Publication Data

US 2009/0277291 A1 Nov. 12, 2009

(51) Int. Cl.
*E21B 1/12* (2006.01)

(52) U.S. Cl. ..... 173/48; 173/216; 81/463

(58) Field of Classification Search ..... 74/86; 173/48, 216, 217; 81/463–466
See application file for complete search history.

(56) References Cited

U.S. PATENT DOCUMENTS 5,451,127 A 9/1995 Chung et al.
6,045,303 A 4/2000 Chung et al.
6,142,242 A 11/2000 Okumura et al.
6,152,242 A 11/2000 Chung et al.
6,202,759 B1 3/2001 Chen et al.
2005/0034882 A1 * 2/2005 Chen ..... 173/48
2009/0126958 A1 * 5/2009 Trautner et al. ..... 173/48

* cited by examiner

*Primary Examiner*—Richard W Ridley
*Assistant Examiner*—Terence Boes
(74) *Attorney, Agent, or Firm*—Rabin & Berdo, P.C.

(57) ABSTRACT

A power output mechanism for power tools includes a main part for driving an output shaft, a switch unit, an impact unit, a pressing unit, and an operation member. The switch unit has a rotation collar for controlling positions of positioning springs. The impact unit includes an orientation wheel movably connected to the output shaft and an operation wheel secured to the output shaft. The orientation wheel includes a first toothed contact surface which is removably engaged with a second toothed contact surface of the operation wheel. A corrugated ring portion is defined on an outer periphery of the orientation wheel and limited from rotation relative to the output shaft when the positioning springs are moved to certain positions. When the positioning springs are engaged with the orientation wheel, the orientation wheel cannot freely rotate relative to the output shaft so that an impact is output.

2 Claims, 5 Drawing Sheets

POWER OUTPUT MECHANISM FOR POWER TOOLS

BACKGROUND OF THE INVENTION

1. Field of the Invention

The present invention relates generally to a power output mechanism for power tools, and more particularly, to a power output mechanism which switches gears smoothly.

2. Background Art

A conventional power tool includes an output shaft which rotates to output torque or impacts the object to provide a impact force to the object. A switch mechanism is provided to switch different gears of status for the output power, and generally the last gear provides rotation and impact simultaneously. However, the conventional power tool includes a complicated structure which includes a base part, a switch unit, an impact unit, a pressing unit, an output shaft and an operation member. The switch unit includes multiple positioning plates which are installed in a frame and the impact unit includes an orientation wheel movably connected to the output shaft and an operation wheel fixed to the output shaft. The orientation wheel and the operation wheel each have a toothed contact surface and the two toothed contact surfaces are engaged with each other. The orientation wheel and the operation wheel are engaged with each other on their corresponding toothed contact surfaces so that when rotating the operation member, the protrusions on the rotation collar driven by the operation member press on the positioning plates such that the positioning plates are engaged with the flanges defined on the outer periphery of the orientation wheel. The rotation of the orientation wheel is limited. In this situation, when the orientation wheel and the operation wheel are moved relative to each other, the operation wheel jumps relative to the orientation wheel due to the toothed contact surfaces. The movement of the operation wheel provides the output shaft an intermittent impact to the object.

However, when the operation member is rotated to an impact position, the positioning plates may fail to insert into the gaps between the flanges of the orientation wheel and engage with flanges to limit the rotation of the orientation wheel. The user has to re-operate again or even more times to set the power tool to the impact mode.

SUMMARY OF THE INVENTION

According to the present invention, a power output mechanism for power tools is provided and comprises a main part for driving an output shaft, a switch unit, an impact unit, a pressing unit and an operation member. The switch unit includes a tubular portion and a rotation collar is mounted to the tubular portion. The tubular portion includes a plurality of slots and the rotation collar includes a plurality of axial protrusions. A plurality of positioning springs are located in the slots of the tubular portion and inserted into the rotation collar. The impact unit has an orientation wheel which is movably connected to the output shaft and an operation wheel which is secured to the output shaft. The orientation wheel includes a first toothed contact surface and the operation wheel includes a second toothed contact surface which is removably engaged with the first toothed contact surface. A corrugated ring portion is defined in an outer periphery of the orientation wheel. The corrugated ring portion includes peaks and valleys. When the rotation collar is rotated to a non-impact position, the positioning springs are located within the rotation collar and do not engage with the valleys so that the orientation wheel is freely rotatable relative to the output shaft. When the rotation collar is rotated to an impact position, the positioning springs are pushed by the rotation collar and engaged with the valleys so that the orientation wheel is restricted to rotate relative to the output shaft, the operation wheel moves periodically toward the orientation wheel so as to output an intermittent impact from the output shaft.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
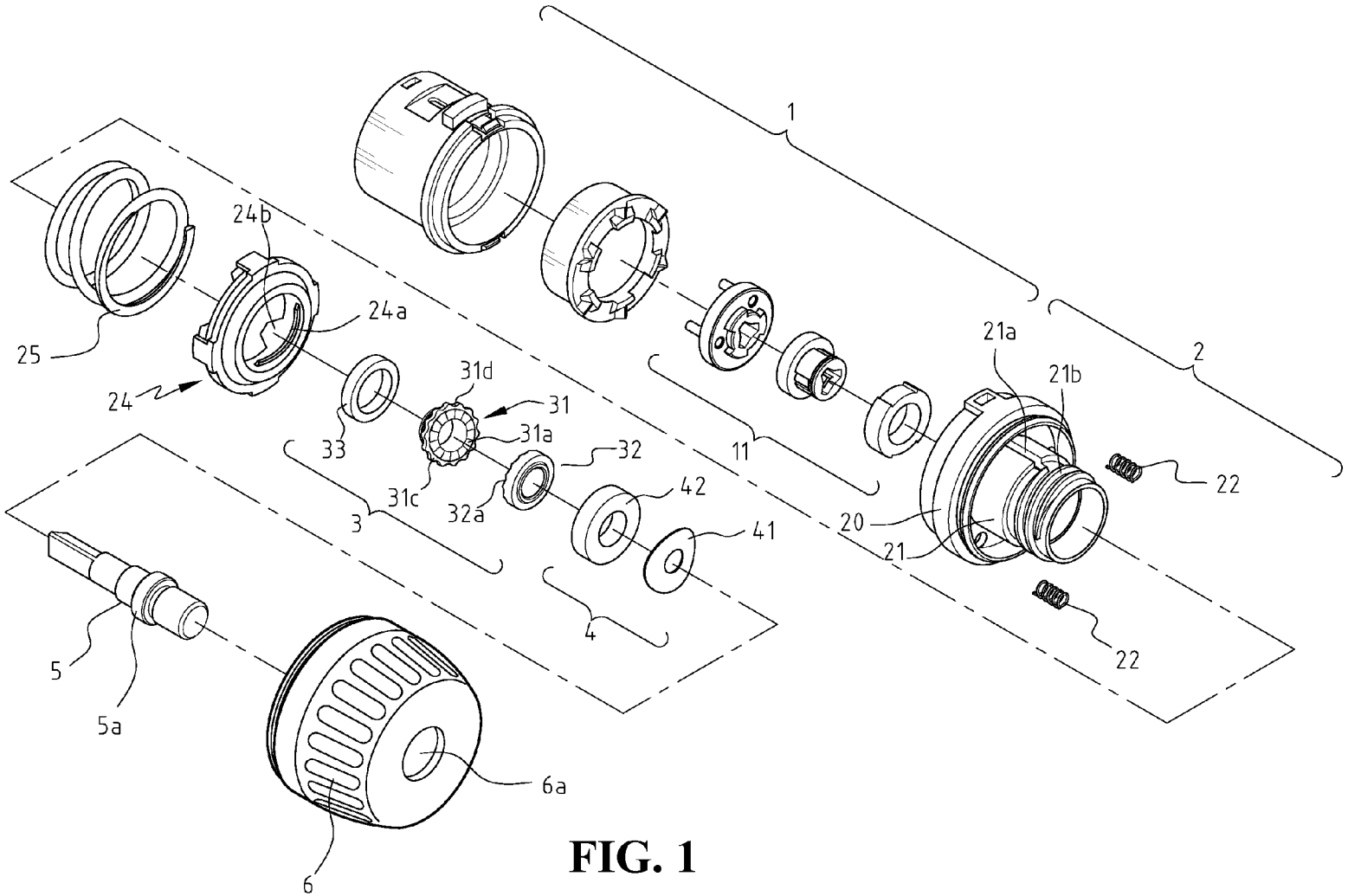
FIG. 1 is an exploded view to show a power output mechanism in accordance with the present invention.
Figure 2:
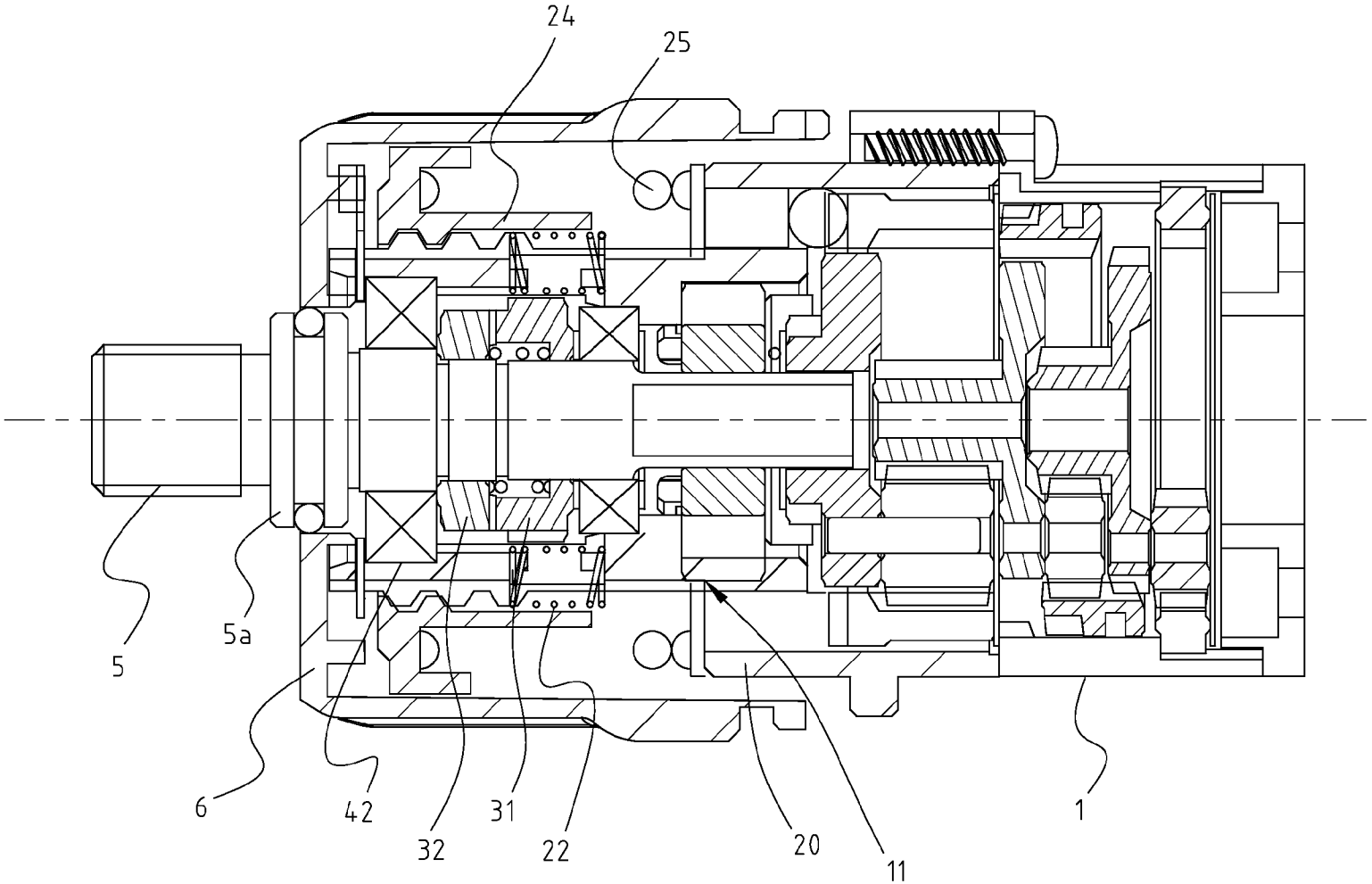
FIG. 2 is a cross-sectional view of the power output mechanism of the present invention.

With reference to the drawings and in particular to FIGS. 1 and 2, a power output mechanism for power tools of the present invention comprises a main part 1, a switch unit 2, an impact unit 3, a pressing unit 4, an output shaft 5 driven by the main part 1, and an operation member 6.

The main part 1 is a driving means which includes an end configured to connect with the switch unit 2 and the end includes an input set 11 extending out of the main part 1.

The switch unit 2 includes a base portion 20 and a tubular portion 21 extending form the base portion 20, and the base portion 20 of the switch unit 2 is connected with the main part 1. A plurality of slots 21*a* are defined through the tubular portion 21 and outer threads 21*b* are defined in an outer periphery of the tubular portion 21. A plurality of positioning springs 22 are compression springs and located within the slots 21*a*. A rotation collar 24 includes inner threads 24*a* which are threadedly connected to the outer threads 21*b* of the tubular portion 21. A plurality of axial protrusions 24*b* extend axially from an underside of the rotation collar 24 so as to be cooperated with the positioning springs 22. A spring 25 is mounted to the tubular portion 21 and two ends of the spring 25 are biased against the base portion 20 of the switch unit 2 and the rotation collar 24, so as to provide an elastic force to the rotation collar 24.

Figure 3:
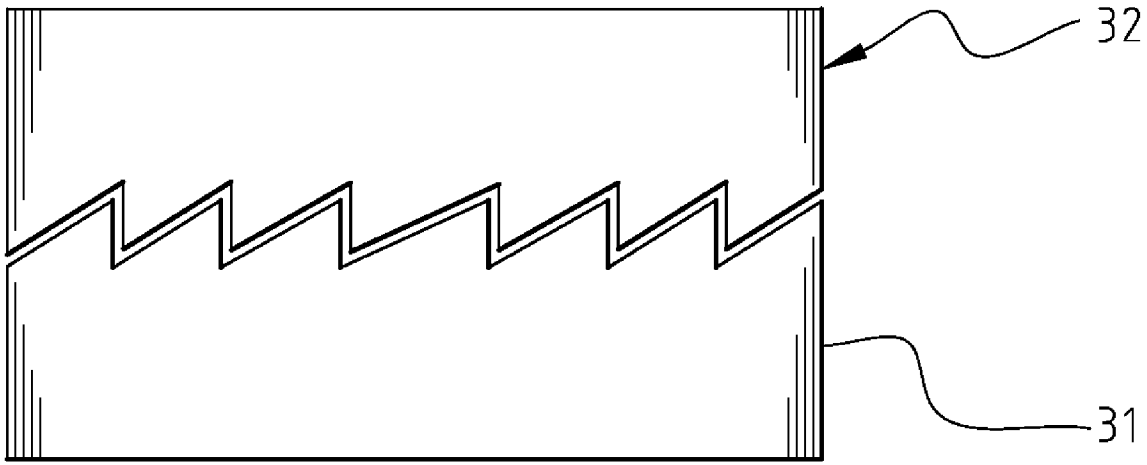
FIG. 3 shows the engagement of an orientation wheel and an operation wheel of the power output mechanism of the present invention.

The impact unit 3 includes an orientation wheel 31, an operation wheel 32 and a bush collar 33. The orientation wheel 31 includes a first toothed contact surface 31*a* with a plurality of teeth extending radially therefrom. The orientation wheel 31 includes a ring portion 31*c* defined on an outer periphery thereof. The ring portion 31*c* has a corrugated surface defining peaks and valleys 31*d*. The operation wheel 32 includes a second toothed contact surface 32*a* which is removably engaged with the first toothed contact surface 31*a*. The first and second toothed contact surface 31*a*, 32*a* have inclined teeth meshed with each other as shown in FIG. 3 so that when the operation wheel 32 is rotated in relative to the orientation wheel 31, the teeth of the second toothed contact surface 32*a* can move over the teeth of the first toothed contact surface 31*a* to create a jump movement.

The pressing unit 4 is composed of a deformed flexible washer 41 and a press ring 42.

The output shaft 5 includes a flange 5*a*. The output shaft 5 extends through the pressing unit 4, the impact unit 3 and the switch unit 2 and is connected with the input set 11 of the main part 1 so that the output shaft 5 is driven by the input set 11. The distal end of the output shaft 5 is to be connected with different tools. The operation wheel 32 is secured to the output shaft 5.

The operation member 6 includes a central hole 6*a* and has an open end in which the rotation collar 24 is engaged such that the operation member 6 can be operated to rotate the rotation collar 24. The output shaft 5 extends through the central hole 6*a* and limited by the flange 5*a* so that the axial position of the output shaft 5 is restricted.

Figure 4:
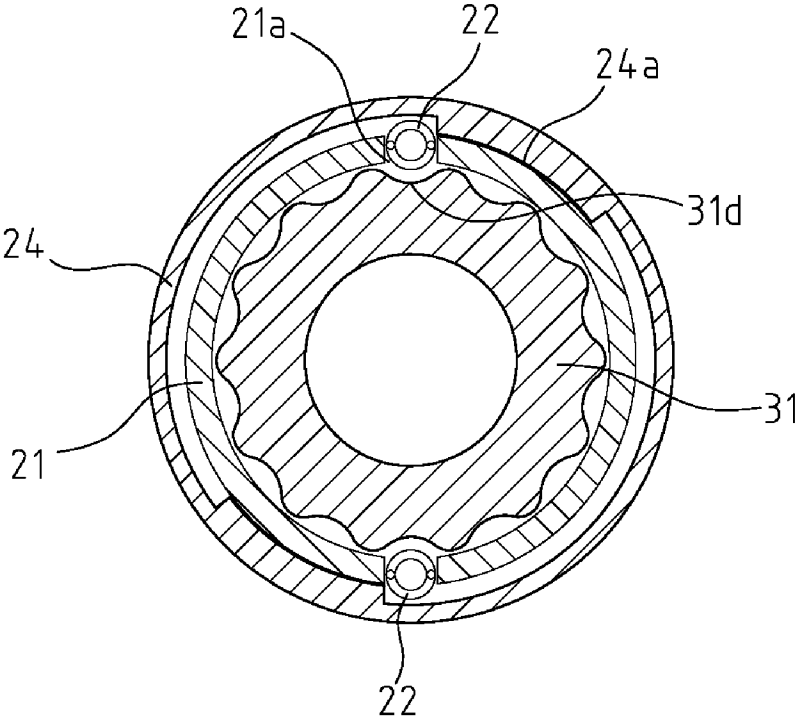
FIG. 4 shows that a rotation collar is rotated to a non-impact position.

The switch unit 2 is used to shift the mechanism to a desired position by operation of the rotation collar 24 and the operation member 6. When the rotation collar 24 is rotated to a non-impact position, the output shaft 5 is pushed by the washers 41 outward so that the axial protrusions 24*b* do not press the positioning springs 22. The positioning springs 22 are located within the rotation collar 24 and do not engage with the valleys 31*d* of the orientation wheel 31 as shown in FIG. 4. Due to the flexibility of the positioning springs 22, when the orientation wheel 31 is rotated relative to the output shaft 5, the peaks of the ring portion 31*c* can pass through the positioning springs 22 such that the orientation wheel 31 can freely rotate. The power tool can output power. In other words, during operation, the output shaft 5 is applied by a force at the distal end thereof, the flanges 5*a* applies an axial force to the washers 41 to move the operation wheel 32 backward to engage the second toothed contact surface 32*a* of the operation wheel 32 with the first toothed contact surface 31*a* of the orientation wheel 31. At this time, because the rotation of the ring portion 31*c* of orientation 31 does not be restricted, the orientation wheel 31 and the operation wheel 32 are engaged together to rotate.

Figure 5:
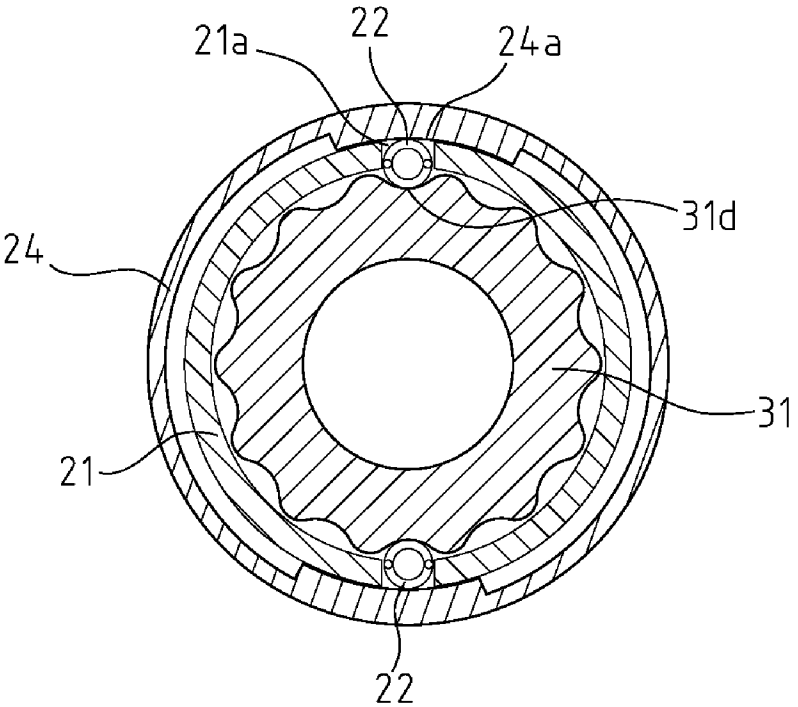
FIG. 5 shows that the rotation collar is rotated to an impact position.

As shown in FIG. 5, when the rotation collar 24 is rotated to an impact position, the inner threads 24*a* of the rotation collar 24 pushes the positioning springs 22 toward the orientation wheel 31 to insert the positioning springs 22 into the valleys 31*d*. The orientation wheel 31 is restricted to rotate relative to the output shaft 5. When the output shaft 5 is applied by a force at the distal end thereof, the flanges 5*a* applies an axial force to the washers 41 to move the operation wheel 32 backward to engage the second toothed contact surface 32*a* of the operation wheel 32 with the first toothed contact surface 31*a* of the orientation wheel 31. Because the rotation of the ring portion 31*c* of the orientation wheel 31 is restricted by the positioning springs 22, the second toothed contact surface 32*a* and the first toothed contact surface 31*a* have a relative movement. The operation wheel 32 moves periodically toward and away from the operation wheel 32 to output an intermittent impact from the output shaft 5.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A power output mechanism for power tools, comprising a main part driving an output shaft, a pressing unit, and an operation member;

a switch unit having a tubular portion and a rotation collar mounted to the tubular portion, the tubular portion including a plurality of slots and the rotation collar including a plurality of axial protrusions;

an impact unit having an orientation wheel which is movably connected to the output shaft and an operation wheel which is secured to the output shaft, the orientation wheel including a first toothed contact surface and the operation wheel including a second toothed contact surface which is removably engaged with the first toothed contact surface, a ring portion defined on an outer periphery of the orientation wheel; and a plurality of positioning springs located in the slots of the tubular portion and inserted into the rotation collar, the ring portion of the orientation wheel having a corrugated surface defining peaks and valleys, wherein when the rotation collar is rotated to a non-impact position, the positioning springs are located within the rotation collar and do not engage with the valleys so that the orientation wheel is freely rotatable relative to the output shaft, when the rotation collar is rotated to an impact position, the positioning springs are pushed by the rotation collar and engaged with the valleys so that the orientation wheel is restricted to rotate relative to the output shaft, the operation wheel moves periodically toward the orientation wheel so as to output an intermittent impact from the output shaft.

2. The power output mechanism as claimed in claim 1, wherein the positioning springs are compression springs.

* * * * *